US008533904B2

(12) United States Patent
Conrad

(10) Patent No.: US 8,533,904 B2
(45) Date of Patent: Sep. 17, 2013

(54) SURFACE CLEANING HEAD

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 313 days.

(21) Appl. No.: 12/915,279

(22) Filed: Oct. 29, 2010

(65) Prior Publication Data

US 2011/0099751 A1 May 5, 2011

(30) Foreign Application Priority Data

Oct. 30, 2009 (CA) ..... 2684168

(51) Int. Cl.
*A47L 5/10* (2006.01)

(52) U.S. Cl.
USPC ..... 15/387; 15/383

(58) Field of Classification Search
USPC ..... 15/383, 385, 387, 421
See application file for complete search history.

(56) References Cited

U.S. PATENT DOCUMENTS

| | | | | |
|---|---|---|---|---|
| 4,306,330 | A * | 12/1981 | Jinkins | 15/325 |
| 5,249,333 | A | 10/1993 | Worwag | |
| 5,293,665 | A | 3/1994 | Worwag | |
| 5,513,418 | A | 5/1996 | Weber | |
| 5,867,864 | A | 2/1999 | Miller et al. | |
| 6,134,746 | A | 10/2000 | Miller et al. | |
| 6,151,752 | A | 11/2000 | Melzner et al. | |
| 6,209,169 | B1 | 4/2001 | Dilger et al. | |
| 6,237,189 | B1 | 5/2001 | Maurer et al. | |
| 6,317,921 | B1 | 11/2001 | Park et al. | |
| 6,513,190 | B1 | 2/2003 | Allgeier et al. | |
| 6,581,240 | B2 | 6/2003 | Kaffenberger | |
| 6,711,777 | B2 | 3/2004 | Frederick et al. | |
| 6,880,200 | B2 | 4/2005 | Yoo | |
| 7,251,857 | B2 | 8/2007 | Caruso | |
| 7,296,324 | B2 * | 11/2007 | Lee | 15/415.1 |
| 7,334,291 | B2 | 2/2008 | Song et al. | |
| 7,441,306 | B2 | 10/2008 | Kim | |
| 7,441,307 | B2 | 10/2008 | Smith | |
| 7,526,834 | B2 | 5/2009 | Coleman | |
| 7,552,507 | B2 | 6/2009 | Burnham | |
| 7,690,079 | B2 | 4/2010 | Boddy et al. | |
| 7,743,463 | B2 | 6/2010 | Smith | |
| 7,765,638 | B2 | 8/2010 | Pineschi et al. | |
| 7,765,639 | B2 | 8/2010 | Lee et al. | |
| 7,770,257 | B2 | 8/2010 | Kim | |
| 7,814,614 | B2 | 10/2010 | Cho et al. | |
| 7,861,368 | B2 | 1/2011 | Hackwell et al. | |
| 7,941,893 | B2 * | 5/2011 | Worwag | 15/319 |
| 8,261,407 | B2 * | 9/2012 | Bozzelli et al. | 15/365 |
| 2003/0106183 | A1 * | 6/2003 | Frederick et al. | 15/387 |
| 2003/0221281 | A1 | 12/2003 | Oh | |
| 2004/0244140 | A1 | 12/2004 | Joo | |

(Continued)

FOREIGN PATENT DOCUMENTS

| | | | |
|---|---|---|---|
| WO | 99/65376 | A1 | 12/1999 |
| WO | 2004/028330 | A1 | 4/2004 |

*Primary Examiner* — Dung Van Nguyen

(74) *Attorney, Agent, or Firm* — Philip C. Mendes da Costa; Bereskin & Parr LLP/S.E.N.C.R.L., s.r.l.

(57) ABSTRACT

A surface cleaning head, such as an auxiliary cleaning head for a vacuum cleaner, has a rotary brush associated with a dirty air inlet and driven by an air turbine. A dirt tray is positioned in the airflow path downstream of the rotary brush. In one embodiment, the air turbine is in an air turbine chamber that is not downstream from the dirty air inlet.

18 Claims, 10 Drawing Sheets

(56) References Cited

U.S. PATENT DOCUMENTS

2005/0217068 A1 10/2005 Kim et al.
2006/0185119 A1 8/2006 Kim et al.
2007/0271726 A1 11/2007 Park
2011/0010887 A1 1/2011 Oh

* cited by examiner

SURFACE CLEANING HEAD

FIELD

The disclosure relates to surface cleaning heads, such as for a vacuum cleaner or other surface cleaning apparatuses. In one preferred embodiment, the disclosure relates to auxiliary surface cleaning head having a rotary brush driven by an air turbine the rotary brush and a dirt tray. In another preferred embodiment, the disclosure relates to a surface cleaning head having two air flow paths comprising a first path having an air turbine and a second path having a rotary brush driven by the air turbine and a dirt tray.

INTRODUCTION

The following is not an admission that anything discussed below is prior art or part of the common general knowledge of persons skilled in the art.

Auxiliary surface cleaning heads are known in the art. Such cleaning heads may be stored on a vacuum cleaner and used in an above floor-cleaning mode. For example, the auxiliary cleaning head may be connected to a wand or a flexible hose of an upright vacuum cleaner for use when the main cleaning head of the vacuum cleaner is not in use. Such auxiliary cleaning head include, for example, crevice tools.

Auxiliary cleaning tools are typically used for specialized tasks. For example, they may be used to clean a surface on which the main cleaning head of an upright vacuum cleaner cannot be used, such as furniture or curtains. Auxiliary cleaning heads may also be used to clean areas that are too small for the main cleaning head such a corners, under furniture or stairs.

SUMMARY

The following summary is provided to introduce the reader to the more detailed discussion to follow. The summary is not intended to limit or define the claims.

According to one aspect, a surface cleaning head for a surface cleaning apparatus is provided that permits the rapid pick up of large dirt particles, such as rice or cat food, or the pick up of a large amount of debris. For example, a user may want to use the surface cleaning head to pick up a food spill. In such a case, the cleaning head may be subjected to a high loading. Due to the high loading, the airflow path in the cleaning head may become clogged reducing the airflow rate through the cleaning head and therefore reducing the amount of material that may be entrained in the airflow. Further, if the cleaning head includes a brush driven by the air turbine, then the reduced airflow through the cleaning head will reduce the power provided to the brush and decrease the effectiveness of the brush. In accordance with one aspect of this invention, a surface cleaning head is provided that comprises an air turbine and a dirt tray. The dirt tray provides an area in which dirt may be accumulated without blocking the airflow path. Accordingly, the airflow rate need not be reduced and the air turbine may provide a required amount of power to a rotary brush. Therefore, the brush will have sufficient rotation momentum to sweep dirt up into the dirt tray. The dirt in the dirt tray may be picked up at a slower rate by the air traveling by the dirt tray. Accordingly, rapid pick up of a spill may be achieved, even with an air turbine powered brush.

In accordance with this aspect, there is provided a surface cleaning head comprising a brush chamber comprising a dirty air inlet and a rotary brush. The surface cleaning head further comprises a dirty air outlet. A dirty airflow path extends between the dirty air inlet and the dirty air outlet. An air turbine is drivingly connected to the rotary brush. A dirt tray is positioned in the airflow path downstream of the rotary brush. The dirt tray has a collection surface.

The surface cleaning head may further comprise an air turbine chamber. The air turbine chamber may be is isolated from the dirty airflow path. The air turbine chamber may comprise an air turbine airflow path extending from an air turbine chamber air inlet to the dirty air outlet. The air turbine may be positioned air turbine airflow path, and the air turbine chamber air inlet may be separated from, and preferably also spaced from, the dirty air inlet. The dirty air outlet may be downstream of the dirty air inlet and the air turbine chamber air inlet. An advantage of this design is that the air turbine is driven by a separate air stream. Air may enter the air turbine chamber and flow through the turbine. If the air turbine chamber has a separate air inlet, then clogging of the airflow path at the dirt air inlet will not deprive the air turbine of airflow and reduce power to the rotary brush.

The air turbine chamber may be positioned above the dirty airflow path, and the air turbine chamber may be positioned above the dirt tray. The air turbine chamber may be positioned adjacent a lateral side of the surface cleaning head. The dirt tray may be positioned upstream from the air turbine. An advantage of such designs is that the air turbine chamber is separated from the air flow path from the dirty air inlet and reduce the likelihood of clogging of the flow path for dirty drawn in through the dirty air inlet.

The surface cleaning head may further comprise a dirt barrier positioned between the dirty air inlet and the dirt tray, such as a ramp. The collection surface may be positioned below an upper end of the dirt barrier. The dirt barrier may be integrally formed with the collection surface. An advantage of using a dirt barrier is that dirt will nor easily fall out of the dirty air inlet when it is stored on the collection surface. This allows large amounts of material to be swept into the dirty air inlet and slowly drawn to the filtration member of the surface cleaning apparatus.

The dirt tray may extend laterally across the surface cleaning head. The dirt tray may have a lateral extent that is generally the same as that of the dirty air inlet.

The collection surface may be formed by a lower wall of the surface cleaning head. Accordingly, the collection surface may be at the level of the dirty air inlet and this may enhance the ability of the cleaning head to pick up large amounts of material.

The surface cleaning head may further comprise a drive linkage that drivingly connects the air turbine to the rotary brush. The drive linkage may comprise a power output shaft. A portion of the power output shaft may be positioned exterior of the air turbine chamber. A fan belt may drivingly connect the power output shaft to the rotary brush. For example, it is preferred that the sir turbine is in an air turbine chamber that draws air into the turbine other then through the dirty air inlet. Accordingly, if the dirty air inlet is clogged by dirt, air will still be drawn into the turbine to power the rotary brush.

The surface cleaning head may further comprise a first air flow path extending from a turbine air chamber air inlet to the dirty air outlet wherein the air turbine is positioned in the first air flow path and a second air flow path from the dirty air inlet to the dirty air outlet.

The surface cleaning head may be an auxiliary surface cleaning head. The outlet may be adapted to be removably connected to an airflow conduit of the surface cleaning apparatus.

DRAWINGS

DETAILED DESCRIPTION OF VARIOUS EXAMPLES

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Figure 1:
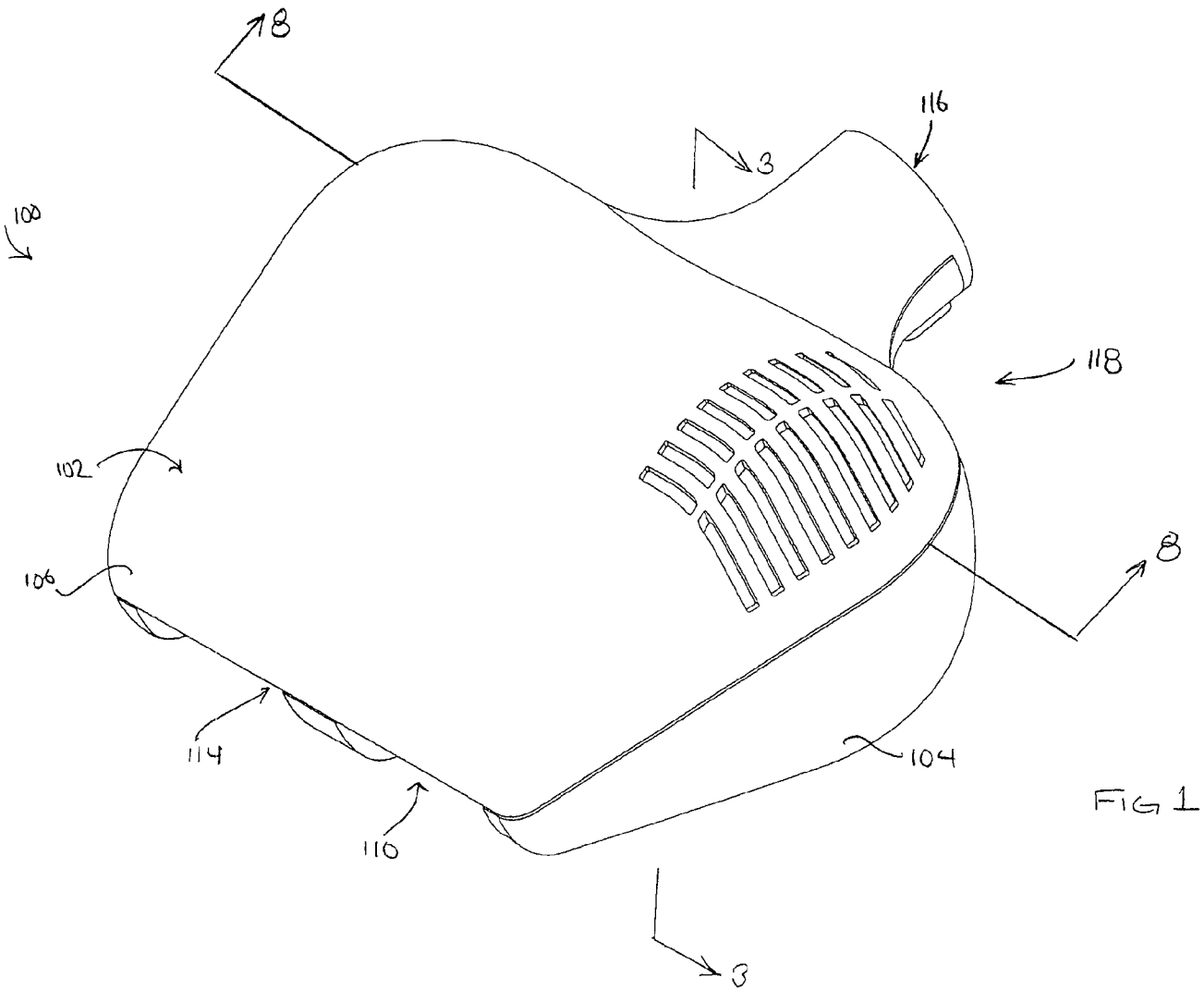
FIG. 1 is a top perspective view of an example of a surface cleaning head.

Referring to FIG. 1, an example of a surface cleaning head 100 is shown. The surface cleaning head 100 may be mounted, and preferably removably mounted, to any suitable surface cleaning apparatus (not shown), such as an upright vacuum cleaner, a canister type vacuum cleaner, a shop-vac type vacuum cleaner, a stick vac or a carpet extractor. The surface cleaning head 100 may be a main surface cleaning head of the surface cleaning apparatus, or may be an auxiliary surface cleaning head of the surface cleaning apparatus, i.e., useable in an alternate cleaning configuration by connection to, e.g., a wand or hose. For example, if the surface cleaning apparatus is an upright vacuum cleaner, namely a vacuum cleaner having an upper section pivotally mounted to a cleaning head, then the surface cleaning head may be the cleaning head to which the upper section is pivotally mounted. The upright vacuum cleaner may have a wand and/or hose used for above floor cleaning. In such a case, the surface cleaning head may be an auxiliary cleaning head that is attachable, and preferably removably attachable, to the wand and/or hose.

Figure 2:
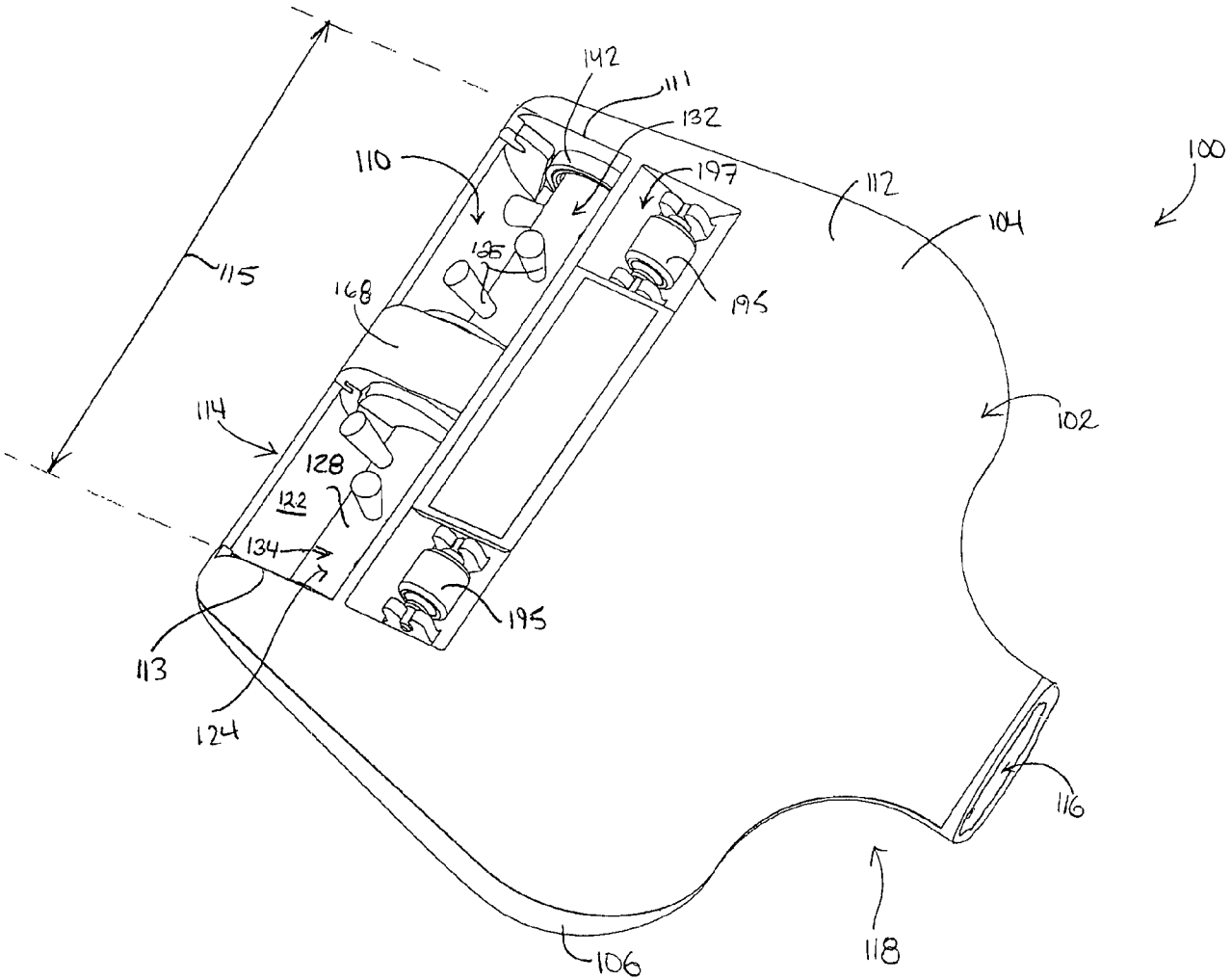
FIG. 2 is a bottom perspective view of the surface cleaning head of FIG. 1.
Figure 3:
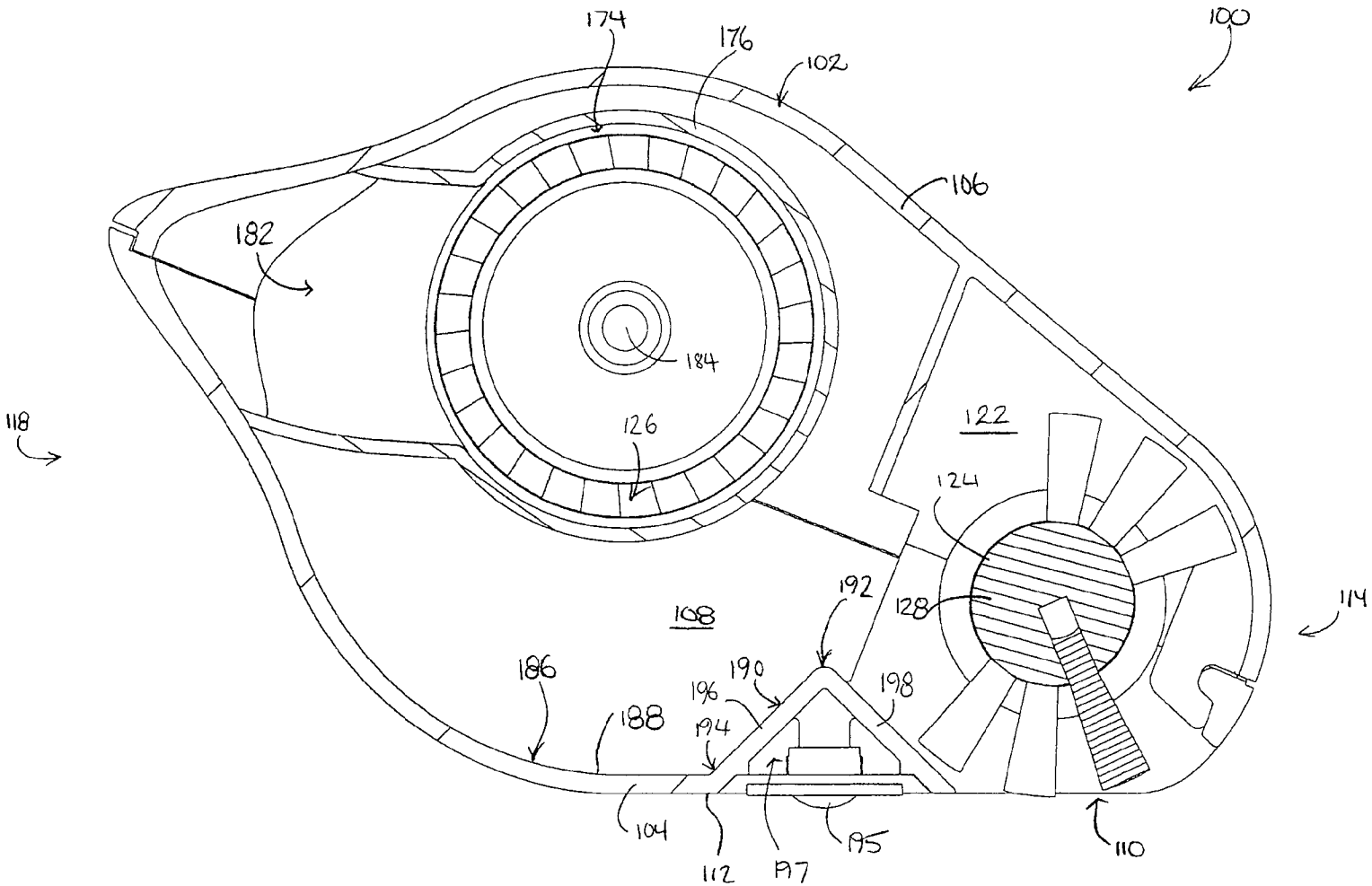
FIG. 3 is a cross section taken along line 3-3 in FIG. 1.

Referring to FIGS. 1 to 3, the surface cleaning head 100 comprises an outer casing 102. As exemplified, the outer casing comprises a bottom plate 104, and a top plate 106, which are mounted together, to define a cavity 108 therebetween. Accordingly, bottom plate 104 may be a lower clam shell and a top plate 106 may be an upper clam shell.

Referring to FIG. 2, the surface cleaning head 100 comprises at least one dirty air inlet 110. As exemplified, a single dirty air inlet 110 is provided that preferably extends generally transversely across the front of the surface cleaning head. Dirty air inlet 110 preferably comprises an opening provided in the bottom plate 104. As exemplified, dirty air inlet 110 is provided in a lower wall 112 of the surface cleaning head 100, towards a front end 114 of the surface cleaning head 100, such that in use, the dirty air inlet 110 is in facing relation to a surface to be cleaned, such as a floor. The dirty air inlet 110 has a first lateral side 111, and a second lateral side 113, and a lateral extent 115 extending therebetween. It will be appreciated that dirty air inlet 110 may be of any configuration known in the art.

Referring still to FIG. 2, the surface cleaning head further comprises a dirty air outlet 116. The dirty air outlet 116 is preferably provided towards a rear end 118 of the surface cleaning head 100. In use surface cleaning head 100 is in fluid communication with a surface cleaning apparatus via dirty air outlet 116. For example, a wand and/or a hose may be connected, and preferably removably connected, to dirty air outlet 116. Any mechanism known in the art to connect a cleaning head, and preferably an auxiliary cleaning head, to a surface cleaning apparatus, may be used.

The dirty air inlet 110 is in fluid communication with the dirty air outlet 116 via a dirty airflow path extending therebetween. As exemplified, the dirty airflow path extends through the cavity 108, between the top plate 106 and the bottom plate 104. The flow of air through the dirty airflow path may be driven, for example, by a motor and fan of the surface cleaning apparatus.

Referring to FIGS. 2 and 3, the surface cleaning head 100 may comprise a brush chamber 122. As exemplified, the brush chamber 122 is formed between the top plate 106 and the bottom plate 104, at the front end 114 of the surface cleaning head 100. The brush chamber 122 may be positioned adjacent or above the dirty air inlet 110. The brush chamber 122 comprises a rotary brush 124, which is rotatably mounted therein. An air turbine 126 is drivingly connected to the rotary brush via a drive linkage 127, as will be described further hereinbelow. The rotary brush 124 comprises a rotary shaft 128, and a plurality of bristles 125 extending therefrom. The rotary shaft 128 is mounted such that the bristles 125 generally extend to the dirty air inlet 110, so that in use, when the dirty air inlet 110 is in facing relation to a surface to be cleaned, the bristles 125 brush the surface to be cleaned. It will be appreciated that rotary brush 124 may be of any design known in the art.

The rotary brush 124 may be rotatably mounted in the brush chamber 122 in any manner known in the art. As exemplified in FIGS. 4 to 6, the rotary shaft 128 comprises a first end portion 132 and an opposed second end portion 134. First and second brackets 142, 144 provide a rotatable mount for rotary shaft 128. As exemplified, the first bracket 142 may be received in a first lateral mount provided adjacent the first lateral side 111 of the dirty air inlet 110. The first lateral mount may comprise a first portion 146 that is integrally formed with the bottom plate 104, and a second portion 148 that is integrally formed with the top plate 106. When the bottom plate 104 is mounted to the top plate 106, the first 146 and second 148 portions align and cooperate to form the first lateral mount. Similarly, the second bracket 144 may be received in a second lateral mount provided adjacent the second lateral side 113 of the dirty air inlet 110, and which may comprise a first portion 158 that is integrally formed with the bottom plate 104, and a second portion 160 that is integrally formed with the top plate 106. When the bottom plate 104 is mounted to the top plate 106, the first 158 and second 160 portions align and cooperate to form the second lateral mount. Accordingly, the rotary brush 124 is mounted to and rotates with respect to the first 142 and second 144 brackets, which are mounted to the top 106 and bottom 104 plates.

As mentioned hereinabove, the rotary brush 124 is driven by an air turbine 126 via a drive linkage 127. Any such drive linkage known in the art may be used. Preferably, a fan belt is used. In a particularly preferred embodiment, air turbine 126 is located in an airflow path that is exterior or separate from the air flow path extending downstream from dirty air inlet 110.

Figure 4:
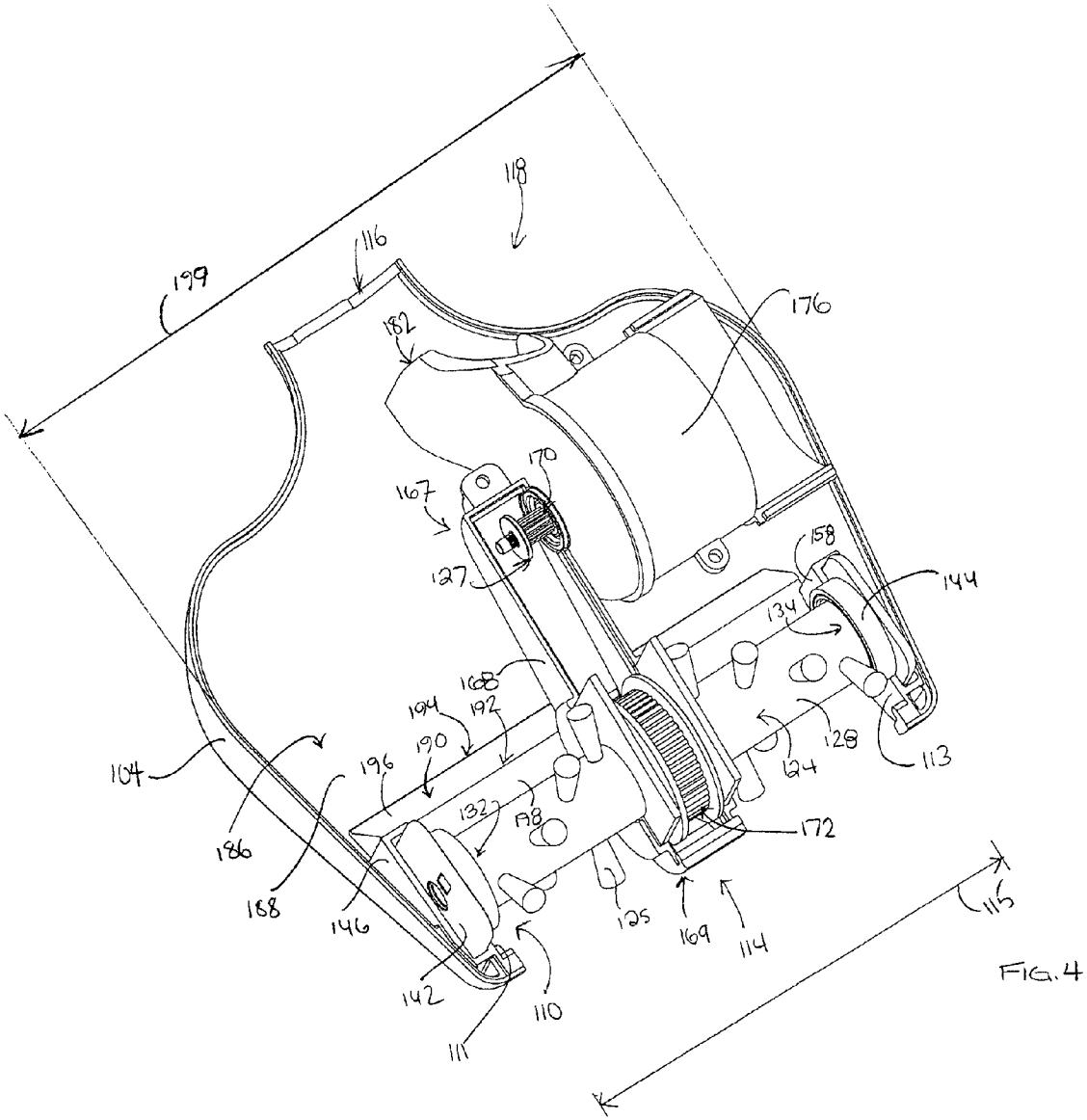
FIG. 4 is a top perspective view of the surface cleaning head of FIG. 1, with a top plate removed from the surface cleaning head.
Figure 5:
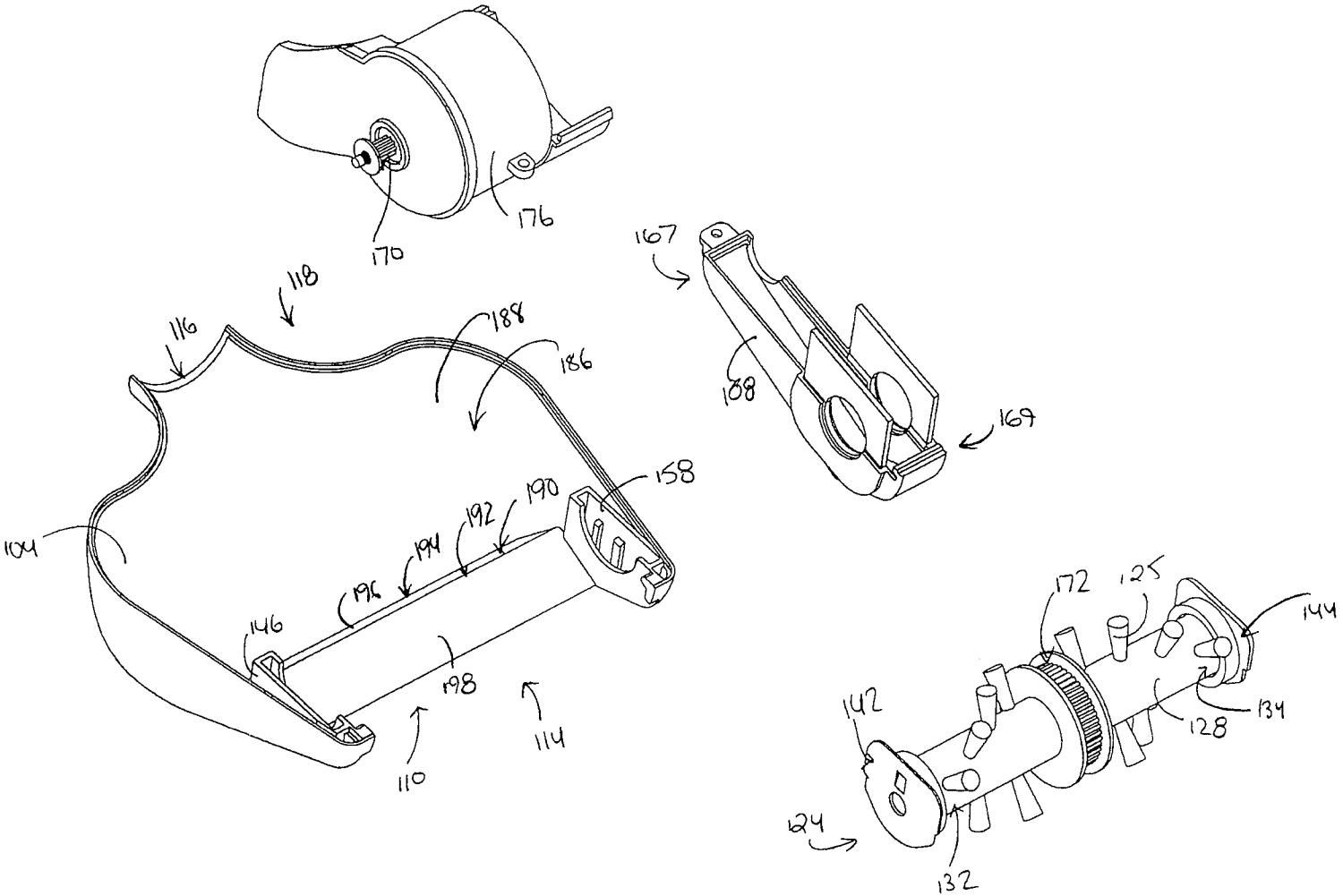
FIG. 5 is an exploded view of the surface cleaning head of FIG. 1, with the top plate removed from the surface cleaning head.
Figure 6:
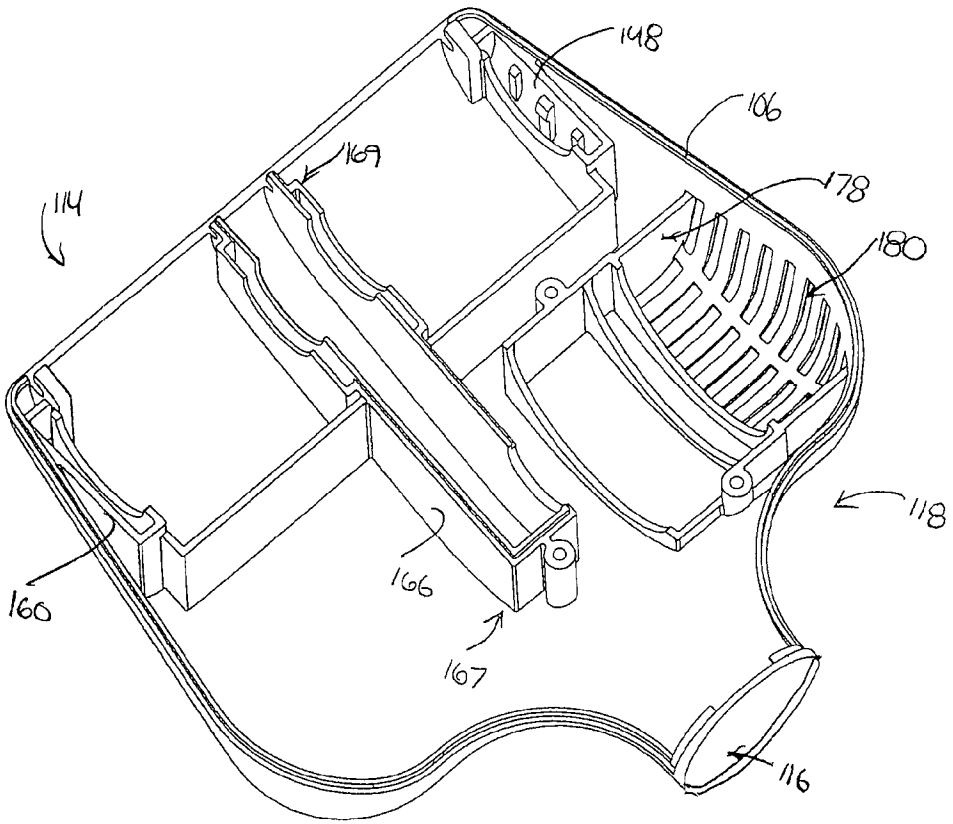
FIG. 6 is a bottom perspective view of the top plate or upper clam shell of the surface cleaning head of FIG. 1.

Referring still to FIGS. 4 to 6, in the example shown, the drive linkage 127 comprises a fan belt (not shown) that extends between pulleys 170, 172, and the surface cleaning head 100 further comprises an optional fan belt housing, which may be positioned within the cavity 108 and may extend rearwardly from the front end 114 of the surface cleaning head 100. As exemplified, the belt housing comprises a first portion 166, which is integrally formed with or removably secured to the top plate 106, and a second portion 168 that may be integrally formed with or removably secured to the bottom plate or which may be removably secured to the first portion 166. When the surface cleaning head 100 is assembled, the first 166 and second 168 halves align and cooperate to form the fan belt housing. If a fan belt housing is provided, it is preferably constructed so as to isolate, or essentially isolate, the fan belt for the air stream passing through chamber 108 and to thereby prevent or reduce contacting the fan belt. In an optional embodiment, top and/or bottom plate 104, 106 may be constructed so as to define the fan belt housing.

Referring to FIGS. 4 and 5, the belt housing comprises a rear portion 167, which is adjacent the air turbine 126, and a front portion 169, through which the rotary shaft 128 extends. A first pulley 170 is mounted in the rear portion. The first pulley 170 is driven by the air turbine 126, as will be described further hereinbelow. A second pulley 172 is mounted in the front portion 169. The second pulley 172 is drivingly connected to rotary shaft 128. For example, the second pulley 172 may be received on and fixedly secured to the rotary shaft 128, such as by a set screw (not shown). The belt is mounted around and between the first pulley 170 and second pulley 172, to transfer rotational motion from the first pulley to the second pulley, as is known to those of skill in the art.

Figure 7:
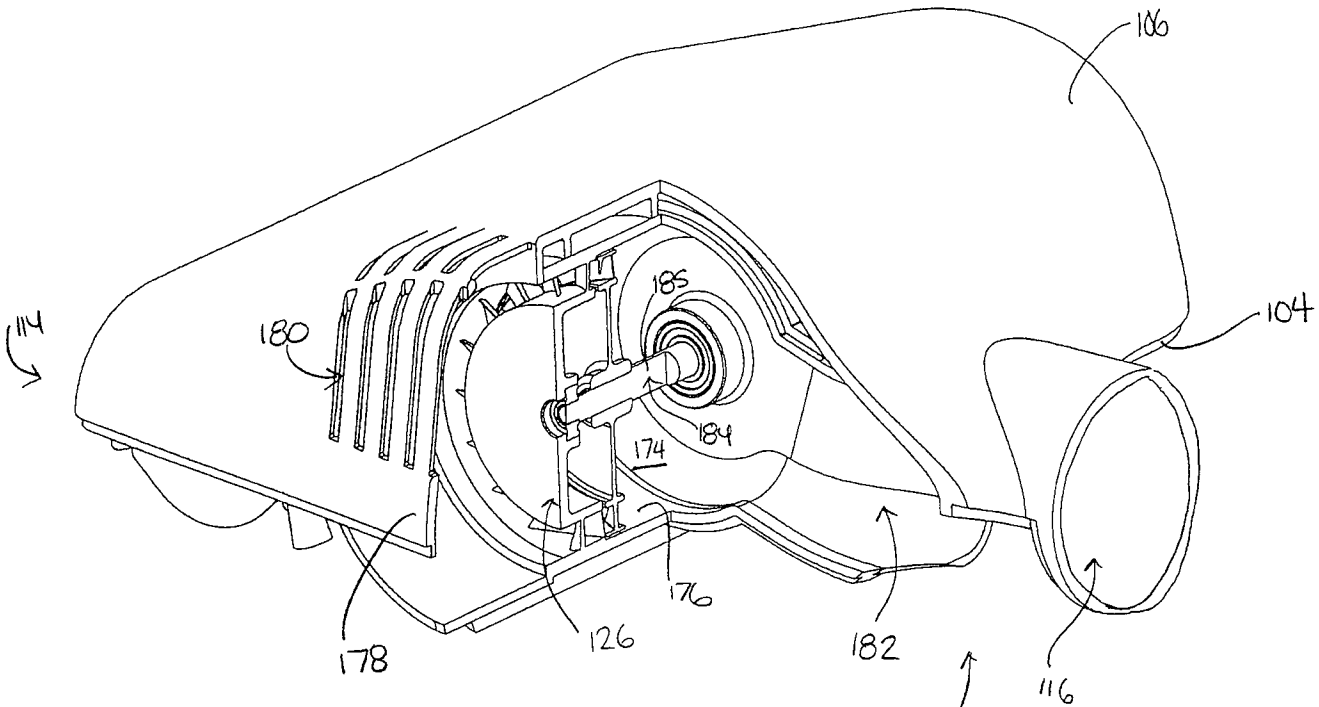
FIG. 7 is a rear perspective cutaway view of the surface cleaning head of FIG. 1.
Figure 8:
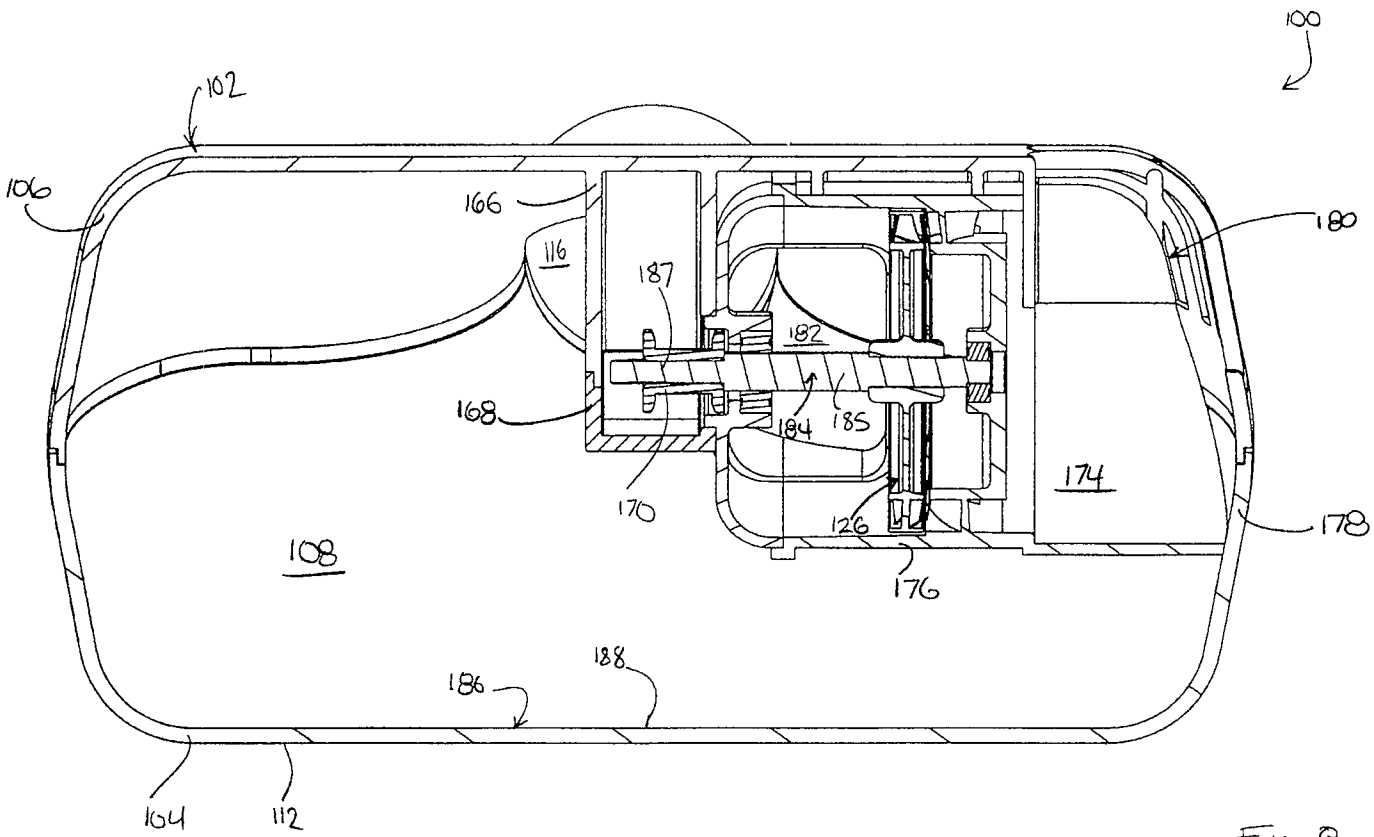
FIG. 8 is a cross section taken along line 8-8 in FIG. 1.

Preferably, as exemplified in FIGS. 7 and 8, the air turbine 126 is provided in an air turbine chamber 174. Air turbine chamber 174 may be at any location and of any design provided that air turbine chamber 174 such that the air that travels past or through the air turbine does not contain dirty air that has been drawn in by the cleaning head 100.

As exemplified, air turbine 126 and the air turbine chamber 174 are positioned in the cavity 108, and isolated from the dirty airflow path. The air turbine chamber 174 is formed by an air turbine casing 176, as well as by a portion 178 of the top plate 106. That is, the air turbine casing 176 and a portion 178 of the top plate 106 cooperate to form the air turbine chamber 174. The air turbine casing 176 may be secured to the portion 178 of the top plate 106 in any suitable manner, such as by a fastener or an adhesive or welding. Any construction technique may be used.

The air turbine chamber 174 comprises an air turbine chamber air inlet 180 upstream of the air turbine 126. As exemplified, the air turbine air inlet 180 is spaced from and separate from the dirty air inlet 110 of the surface cleaning head, and may comprise a grill formed in the portion 178 of the top plate 106. The air turbine chamber 174 further comprises an air turbine chamber air outlet 182 downstream of the air turbine 126. As exemplified, the air turbine chamber air outlet 182 comprises an opening in the air turbine casing 176. The air turbine chamber air outlet 182 is within the cavity 108, and is upstream of the dirty air outlet 116 of the surface cleaning head 100. Accordingly, an air turbine airflow path is a second airflow path in cleaning head 100 and extends from the air turbine chamber air inlet 180, out of the air turbine chamber air outlet 182. The air turbine 126 is positioned in the air turbine airflow path.

As a suction force is created by the surface cleaning apparatus, air is drawn from air outlet 116. Accordingly, air will be drawn into the air turbine chamber 174 via the air turbine chamber air inlet 180, past the air turbine 126 causing the air turbine to rotate, out of the air turbine chamber air outlet 182, into the cavity 108, and out of the dirty air outlet 116. At the same time, air will be drawn in from dirty air inlet 110 and flow through chamber 108 to air outlet 116.

As mentioned hereinabove, the air turbine 126 is drivingly connected to the first pulley 170. As shown, the air turbine 126 is mounted to a power output shaft 184, a first portion 185 of which is received in the air turbine casing 176, and a second portion 187 of which is positioned exterior to the air turbine casing 176, e.g., within the fan belt housing. The second portion is mounted to the first pulley 170. The power output shaft 184 is drivingly connected to the rotary brush 124 by the fan belt.

Preferably, as exemplified, the air turbine chamber 174, as well as the air turbine 126, is positioned adjacent a lateral side of the surface cleaning head 100, and is above the dirty airflow path. Accordingly, the air turbine chamber is positioned so as to impart a minimal restriction to airflow through chamber 108. In alternate examples, the air turbine chamber 174 and the air turbine 126 may be positioned in another position. For example, the air turbine chamber 174 and air turbine 126 may be centrally positioned between opposed lateral sides of the surface cleaning head 100. Further, the air turbine chamber 174 and air turbine 126 may be positioned below the dirty airflow path, or centrally within the airflow path. In some examples, the air turbine may be in chamber 108, i.e. a separate air turbine chamber need not be provided (see the embodiment of FIGS. 9 and 10).

Referring back to FIGS. 3 to 5, the surface cleaning head 100 further comprises a dirt tray 186 in the airflow path, downstream of the rotary brush 124. Dirt tray may be of any construction that will provide a surface on which dirt, particularly larger and/or heavier dirt particles may accumulate if the dirt particles are not able to be drawn directly to air outlet 116. Accordingly, dirt tray 186 is positioned such that the dirt that is accumulated thereon may be brushed thereon by the rotary brush and is preferably immediately downstream of dirty air inlet 110. Further, a barrier 190 may be provided to prevent such dirt particles from fall out of dirt air inlet 110.

Preferably, as exemplified, the dirt tray 186 extends laterally across the surface cleaning head 100. The dirt tray 186 comprises a collection surface 188. When the surface cleaning head 100 is in use, dirt or other materials are brushed or directed by the brush 124 into the surface cleaning head 100 via the dirty air inlet 110, and are brushed onto the collection surface 188. From the collection surface 188, the dirt or other materials are entrained in the airflow passing thereabove and drawn out of the surface cleaning head 100 via the dirty air outlet 116.

In the example shown, the collection surface 188 is formed by the lower wall 112 of the bottom plate 106. In alternate examples, the collection surface 188 may be formed by any other suitable surface.

A dirt barrier 190 is positioned between the dirty air inlet 110 and the dirt tray 186. The dirt barrier 190 is preferably constructed so as to require dirt to travel upwardly to fallout of dirty air inlet 110. Accordingly, barrier 190 may be a ramp and dirt may be swept by the rotary brush up the ramp. Alternately, collection surface 188 may be below dirty air inlet 110 such that a wall, e.g., a vertical wall extends downwardly from dirty air inlet 110 to collection surface 188 (see the embodiment of FIGS. 9 and 10).

As exemplified, dirt barrier is a ramp that is generally upwardly extending, and has an upper end 192 and a lower end 194. The collection surface 188 is positioned below the upper end 192. The dirt barrier 190 generally prevents or inhibits dirt from exiting the surface cleaning head 100 via the dirty air inlet 110.

As exemplified, the dirt barrier 190 is integrally formed with the collection surface 188, and comprises a first wall 196 extending upwardly and forwardly from the collection surface 188, and a second wall 198 extending downwardly and forwardly from the first wall 196. Accordingly, the dirt barrier 190 may be generally triangular in transverse cross-section. As can be seen in FIG. 2, the dirt barrier 190 may therefore form a recess 197 in the bottom plate 104, in which one or more wheels 195 may be received. In alternate examples, the dirt barrier may be another suitable shape. For example, the dirt barrier may comprise a single wall extending vertically upwardly from the collection surface 188.

Preferably, as exemplified, the dirt tray 186 has a lateral extent 199 that is slightly longer than the lateral extent 115 of the dirty air inlet 110. In alternate embodiments, the lateral extent 199 of the dirt tray 186 may be less than or is generally the same as the lateral extent 115 of the dirty air inlet 110.

As exemplified in FIG. 8, the air turbine 126 and air turbine chamber 174 are above the dirt tray 186, and the airflow path extends between the dirt tray 186 and the air turbine chamber 174. In alternate examples, the air turbine chamber 174 may be seated on or adjacent to the dirt tray 186. Further, as exemplified, the dirty airflow path along the dirt tray 186 is parallel to the air turbine airflow path. In alternate examples, the airflow path along the dirt tray 186 may be in sequence with the air turbine airflow path. For example, the air turbine air inlet 180 may be in communication with and downstream of the dirty air inlet 110, and the dirt tray 186 may be either upstream or downstream of the air turbine 126.

Figure 9:
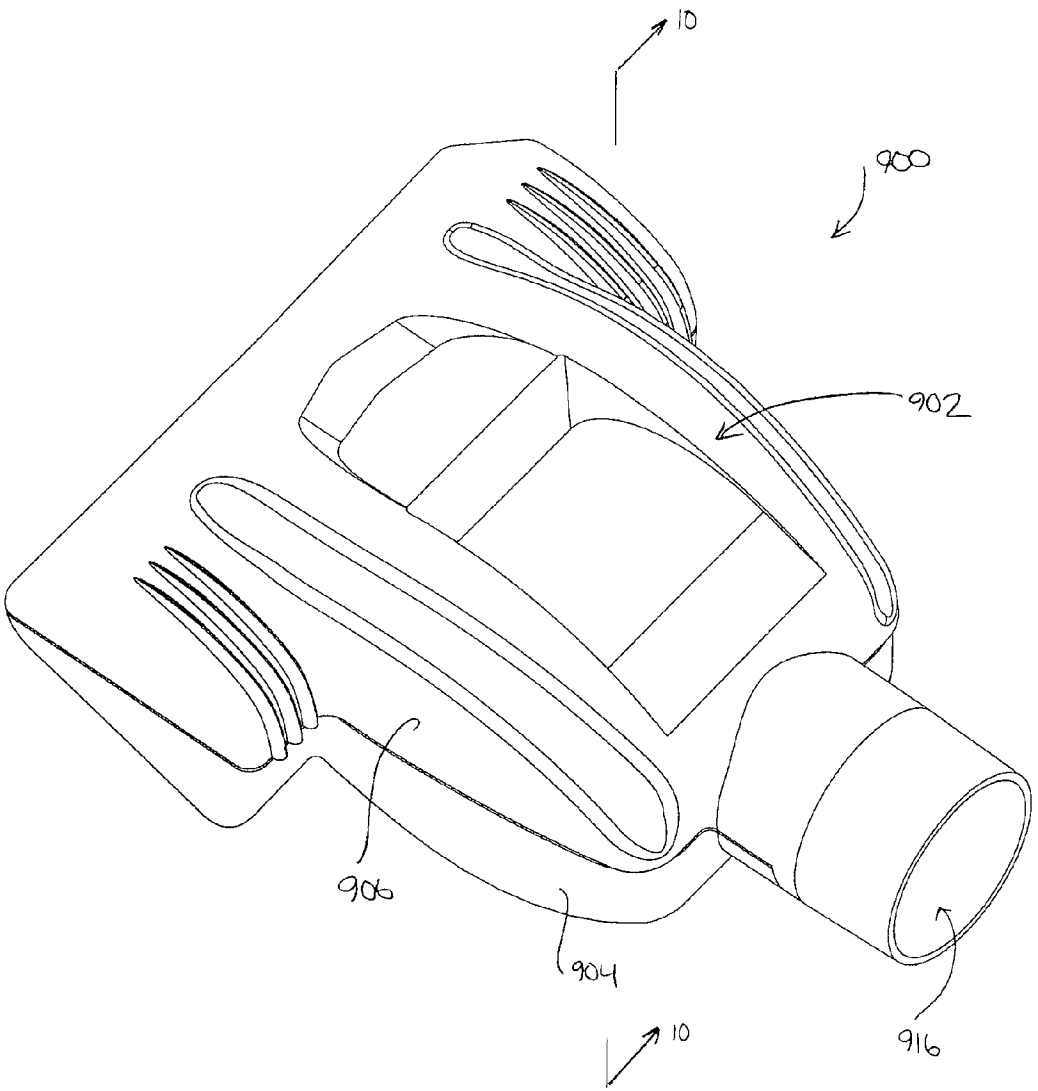
FIG. 9 is a top perspective view of an alternate example of a surface cleaning head; and, FIG. 10 is a cross section taken along line 10-10 in FIG. 9.
Figure 10:
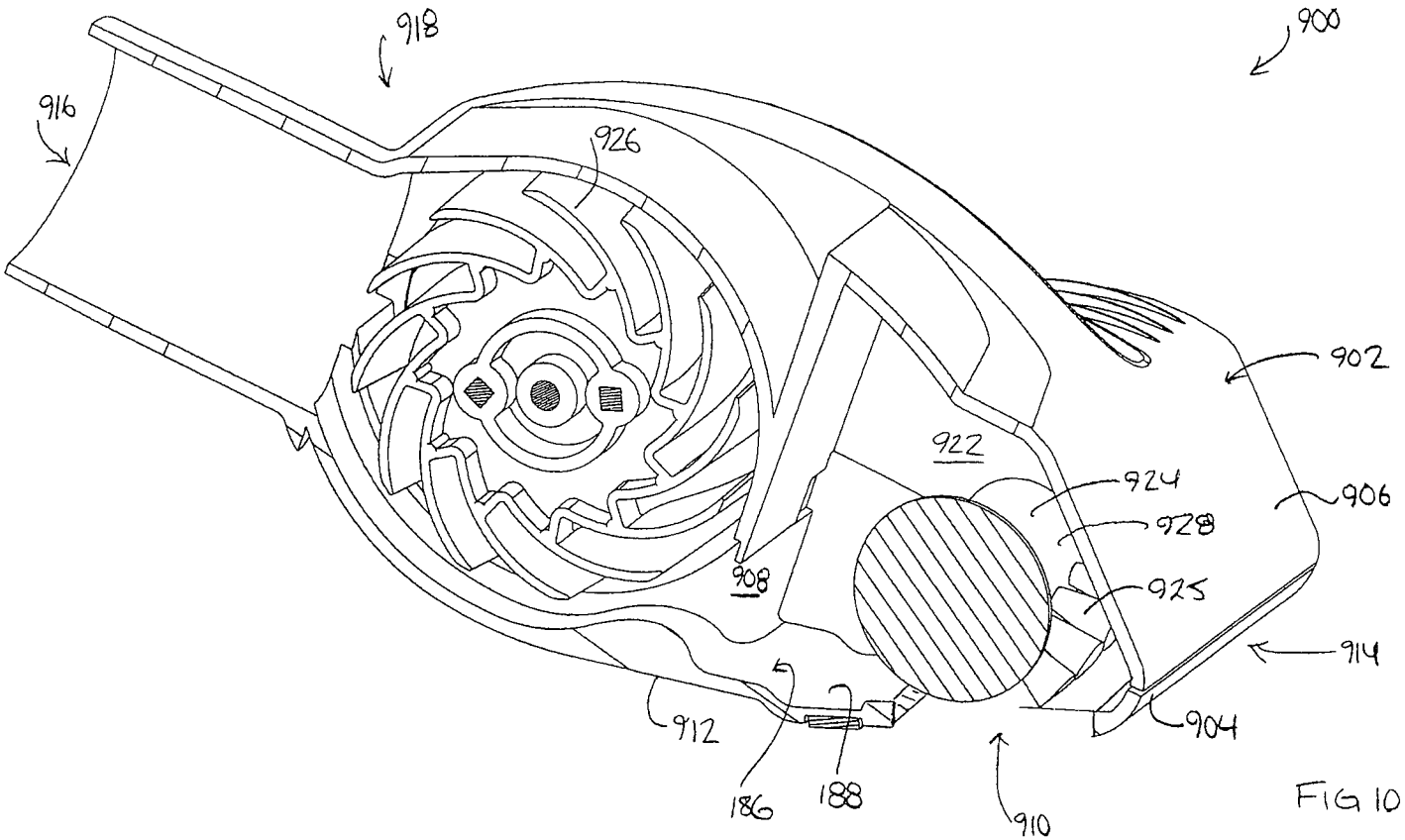

Referring to FIGS. 9 and 10, wherein like numerals are used to indicate like features as in FIGS. 1 to 8, with the first digit incremented to 9 to refer to the figure number, an alternate example of a surface cleaning head is shown. Similarly to the example of FIG. 1, the surface cleaning head 900 comprises a casing 902, which is formed by a bottom plate 904 and a top plate 906. A cavity 908 is formed between the bottom plate 904 and the top plate 906, and the cavity defines an airflow path between a dirty air inlet 910 and a dirty air outlet 916. The surface cleaning head 900 comprises a brush chamber 922, which houses a rotary brush 924, and which includes the dirty air inlet 910.

Similarly to the example of FIGS. 1 to 8, an air turbine 926 is drivingly connected to the rotary brush 924. However, in the example of FIGS. 9 and 10, the air turbine 926 is provided in the airflow path upstream of dirty air inlet 910. That is, the air turbine 926 is not provided in a separate casing, and does not include an air turbine inlet that is separate from the dirty air inlet. Air entering the dirty air inlet 910 passes through the air tribune 926.

Similarly to the example of FIGS. 1 to 8, a dirt tray 986 is provided in the airflow path, downstream of the rotary brush 924. The dirt tray 986 comprises a collection surface 988, onto which materials are brushed by the rotary brush 924. The collection surface is below the upper end of the vertical wall defining the dirty air inlet. In this embodiment, the dirt tray 986 is positioned upstream of the air turbine 926.

What has been described above has been intended to be illustrative of the invention and non-limiting and it will be understood by persons skilled in the art that other variants and modifications may be made without departing from the scope of the invention as defined in the claims appended hereto.

What is claimed is:

1. A surface cleaning head for a surface cleaning apparatus comprising:

a) a brush chamber comprising a dirty air inlet and a rotary brush;

b) a dirty air outlet, and a dirty airflow path extending between the dirty air inlet and the dirty air outlet;

c) an air turbine positioned in an air turbine chamber wherein the air turbine chamber is isolated from the dirty airflow path, the air turbine being drivingly connected to the rotary brush; and, d) a dirt tray in the airflow path downstream of the rotary brush, the dirt tray having a collection surface.

2. The surface cleaning head of claim 1, wherein the dirt tray is positioned upstream from the air turbine.

3. The surface cleaning head of claim 2, further comprising a first air flow path extending from a turbine air chamber air inlet to the dirty air outlet wherein the air turbine is positioned in the first air flow path and a second air flow path from the dirty air inlet to the dirty air outlet.

4. The surface cleaning head of claim 1, wherein the air turbine chamber comprises an air turbine airflow path extending from an air turbine chamber air inlet to the dirty air outlet and the air turbine is positioned air turbine airflow path.

5. The surface cleaning head of claim 4, wherein the air turbine chamber air inlet is separate from the dirty air inlet.

6. The surface cleaning head of claim 5, wherein the dirty air outlet is downstream of the dirty air inlet and the air turbine chamber air inlet.

7. The surface cleaning head of claim 4, wherein the dirty air outlet is downstream of the dirty air inlet and the air turbine chamber air inlet.

8. The surface cleaning head of claim 1, wherein the air turbine chamber is positioned above the dirty airflow path.

9. The surface cleaning head of claim 1, wherein the air turbine chamber is positioned above the dirt tray.

10. The surface cleaning head of claim 1, wherein the air turbine chamber is positioned adjacent a lateral side of the surface cleaning head.

11. The surface cleaning head of claim 1, further comprising a dirt barrier positioned between the dirty air inlet and the dirt tray and the collection surface is positioned below an upper end of the dirt barrier.

12. The surface cleaning head of claim 11, wherein the dirt barrier is integrally formed with the collection surface.

13. The surface cleaning head of claim 1, wherein the dirt tray extends laterally across the surface cleaning head.

14. The surface cleaning head of claim 1, wherein the collection surface is formed by a lower wall of the surface cleaning head.

15. The surface cleaning head of claim 1, further comprising a drive linkage that drivingly connects the air turbine to the rotary brush and comprises a power output shaft, a portion of the power output shaft positioned exterior of the air turbine chamber and a fan belt drivingly connecting the power output shaft to the rotary brush.

16. The surface cleaning head of claim 1, further comprising a first air flow path extending from a turbine air chamber air inlet to the dirty air outlet wherein the air turbine is positioned in the first air flow path and a second air flow path from the dirty air inlet to the dirty air outlet.

17. The surface cleaning head of claim 1, wherein the surface cleaning head is an auxiliary surface cleaning head and the outlet is adapted to be removably connected to an airflow conduit of the surface cleaning apparatus.

18. A surface cleaning head comprising:

a) a brush chamber comprising a dirty air inlet and a rotary brush;

b) a dirty air outlet, and a dirty airflow path extending between the dirty air inlet and the dirty air outlet;

c) an air turbine drivingly connected to the rotary brush; and, d) a dirt tray in the airflow path downstream of the rotary brush, the dirt tray having a collection surface and a lateral extent that is generally the same as that of the dirty air inlet.

* * * * *